US011224282B2

(12) United States Patent
Wong et al.

(10) Patent No.: US 11,224,282 B2
(45) Date of Patent: Jan. 18, 2022

(54) ORAL CARE IMPLEMENT

(71) Applicant: Colgate-Palmolive Company, New York, NY (US)

(72) Inventors: Chi Shing Wong, Warren, NJ (US); Douglas Hohlbein, Hopewell, NJ (US); Bo Zhang, Yangzhou (CN)

(73) Assignee: Colgate-Palmolive Company, New York, NY (US)

( * ) Notice: Subject to any disclaimer, the term of this patent is extended or adjusted under 35 U.S.C. 154(b) by 690 days.

(21) Appl. No.: 15/551,453

(22) PCT Filed: Feb. 18, 2015

(86) PCT No.: PCT/CN2015/073235
§ 371 (c)(1),
(2) Date: Aug. 16, 2017

(87) PCT Pub. No.: WO2016/131197
PCT Pub. Date: Aug. 25, 2016

(65) Prior Publication Data

US 2018/0042373 A1 Feb. 15, 2018

(51) Int. Cl.
*A46B 9/04* (2006.01)
*A46B 9/06* (2006.01)
*A46B 15/00* (2006.01)

(52) U.S. Cl.
CPC ..... *A46B 9/04* (2013.01); *A46B 9/06* (2013.01); *A46B 15/0081* (2013.01); *A46B 15/0089* (2013.01); *A46B 2200/1066* (2013.01)

(58) Field of Classification Search
CPC ... A46B 9/04; A46B 15/0085; A46B 15/0087; A46B 15/0075; A46B 15/0081;
(Continued)

(56) References Cited

U.S. PATENT DOCUMENTS 3,613,143 A 10/1971 Muhler et al.
5,427,595 A 6/1995 Pihl et al.
(Continued)

FOREIGN PATENT DOCUMENTS

CN 201767325 3/2011
WO WO1996/33638 10/1996
(Continued)

OTHER PUBLICATIONS

Prospector Styrene Acrylonitrile Plastic (Year: 2015).*
(Continued)

*Primary Examiner* — Michael D Jennings
*Assistant Examiner* — Makena S Markman

(57) ABSTRACT

An oral care implement (100) includes an elastomeric component and a method of forming the same. In one embodiment, the oral care implement (100) includes a handle (120) and a head (110). The elastomeric component is positioned on at least one of the handle (120) and the head (110). The elastomeric component includes a body, a plurality of the first particles (202), and a plurality of the second particles (203). The body comprises a transparent or translucent elastomeric material. The pluralities of first and second particles are embedded in the body of the elastomeric component. The plurality of first particles (202) includes a first color and the plurality of second particles (203) includes a second color. The elastomeric component may form a tissue cleanser (140) on a rear surface of the head, an elastomeric tooth cleaning element (150) on a front surface of the head, and/or a grip (121) on the handle (120).

15 Claims, 7 Drawing Sheets

(58) Field of Classification Search
CPC .. A46B 2200/1066; A61H 13/00; B25G 1/00; B25G 1/10; B25G 1/102
USPC ..... 15/167.1, 143.1, 110, 111, 188; 606/161; 601/141
See application file for complete search history.

(56) References Cited

U.S. PATENT DOCUMENTS

| | | | | |
|---|---|---|---|---|
| 5,722,106 | A | 3/1998 | Masterman et al. | |
| 5,735,011 | A | 4/1998 | Asher | |
| 6,163,918 | A | 12/2000 | Weihrauch | |
| 6,296,934 | B1 | 10/2001 | Needham et al. | |
| 6,312,782 | B1 * | 11/2001 | Goldberg | A43B 1/0036 12/146 B |
| 7,389,781 | B2 * | 6/2008 | Kemp | A46B 5/00 132/308 |
| 7,712,175 | B2 | 5/2010 | Blanchard et al. | |
| 8,398,326 | B2 * | 3/2013 | Jimenez | A46B 11/001 401/282 |
| 8,424,144 | B2 * | 4/2013 | Nanda | A46B 15/0002 15/22.1 |
| 8,429,783 | B2 * | 4/2013 | Russell | A46B 7/00 15/105 |
| 8,448,284 | B2 * | 5/2013 | Gross | A46B 5/02 15/143.1 |
| 8,556,530 | B2 * | 10/2013 | Hohlbein | A46B 5/00 401/183 |
| 8,557,323 | B2 * | 10/2013 | Stawski | A23G 3/34 426/660 |
| 8,601,635 | B2 * | 12/2013 | Goldman | A46B 9/026 15/167.1 |
| 9,167,887 | B2 | 10/2015 | Xi et al. | |
| 9,167,890 | B2 * | 10/2015 | Hohlbein | A46B 15/0087 |
| 9,462,877 | B2 | 10/2016 | Xi | |
| 9,510,668 | B2 * | 12/2016 | Patel | A46B 9/04 |
| 9,554,640 | B2 * | 1/2017 | Hohlbein | A46D 3/00 |
| 9,603,442 | B2 * | 3/2017 | Jimenez | B23P 11/02 |
| 10,098,447 | B2 * | 10/2018 | Newman | A46B 9/06 |
| 2003/0008144 | A1 * | 1/2003 | Whitney | B32B 7/02 428/402 |
| 2004/0074031 | A1 | 4/2004 | Davies et al. | |
| 2004/0143920 | A1 | 7/2004 | Puneet | |
| 2005/0193510 | A1 * | 9/2005 | Kemp | A46B 5/00 15/143.1 |
| 2007/0039109 | A1 * | 2/2007 | Nanda | A46B 5/00 15/105 |
| 2007/0163064 | A1 * | 7/2007 | Wong | A46B 5/026 15/143.1 |
| 2007/0209263 | A1 * | 9/2007 | Hohlbein | G09F 23/0075 40/625 |
| 2009/0313778 | A1 * | 12/2009 | Wong | A46B 15/0016 15/167.1 |
| 2010/0043162 | A1 | 2/2010 | Zimmermann et al. | |
| 2010/0178252 | A1 * | 7/2010 | Sagel | A46B 7/04 424/9.6 |
| 2013/0255020 | A1 * | 10/2013 | Xi | A61C 17/00 15/167.1 |
| 2013/0276252 | A1 * | 10/2013 | Xi | A46B 9/04 15/105 |
| 2014/0325778 | A1 * | 11/2014 | Chang | A46B 15/0081 15/167.1 |
| 2015/0007401 | A1 * | 1/2015 | Waguespack | A46B 9/04 15/105 |

FOREIGN PATENT DOCUMENTS

| | | |
|---|---|---|
| WO | WO1999/60886 | 12/1999 |
| WO | 2012/083490 | 6/2012 |
| WO | 2015/155594 | 10/2015 |

OTHER PUBLICATIONS

Prospector Acrylonitrile Butidiene Styrene (Year: 2014).*
International Search Report and the Written Opinion of the International Searching Authority issued in International Application PCT/CN2015/073235 dated Nov. 20, 2015.

* cited by examiner

ORAL CARE IMPLEMENT

BACKGROUND

A toothbrush is used to clean the teeth by removing plaque and debris from the tooth surfaces. Toothbrushes have a handle for gripping and a head which is inserted into a user's mouth for tooth and oral surface cleaning. The head typically has bristles formed of nylon and sometimes also cleaning elements formed from elastomeric materials to perform the cleaning function. Furthermore, some toothbrushes have been developed that include a tongue or soft tissue cleanser formed of an elastomeric material on the opposite surface of the head relative to the bristles. Other components of conventional toothbrushes are formed with elastomeric materials, such as a handle grip. However, in conventional toothbrushes these components that are formed from elastomeric materials only serve a single purpose of tooth or soft tissue cleaning or grip enhancement. Thus, a need exists for an oral care implement that includes a component formed from an elastomeric material that is more aesthetically pleasing, can be informative, and that does not increase the costs of manufacture of the oral care implement.

BRIEF SUMMARY

The present invention is directed to an oral care implement that includes a handle, a head, and an elastomeric component. The elastomeric component is positioned on at least one of the handle and the head. The elastomeric component includes a body, a plurality of first particles, and a plurality of second particles. The body comprises a transparent or translucent elastomeric material. The plurality of first and second particles are embedded in the body of the elastomeric component. The plurality of first particles include a first color and the plurality of second particles include a second color. The elastomeric component may form a tissue cleanser on a rear surface of the head, an elastomeric tooth cleaning element on a front surface of the head, and/or a grip on the handle.

In one aspect, the invention can be an oral care implement comprising: a handle; a head coupled to the handle, the head having a front surface and an opposing rear surface; an elastomeric component positioned on at least one of the handle and the head, the elastomeric component comprising a body, a plurality of first particles embedded in the body, and a plurality of second particles embedded in the body; wherein the body comprises a transparent or translucent elastomeric material; and wherein the plurality of first particles comprise a first color and the plurality of second particles comprise a second color, the first color being different than the second color.

In another aspect, the invention can be an oral care implement comprising: a handle; a head coupled to the handle, the head having a front surface and an opposing rear surface; an elastomeric component positioned on at least one of the handle and the head, the elastomeric component comprising a body and a plurality of first particles disposed within the body; wherein the body comprises a transparent or translucent elastomeric material; and wherein the plurality of first particles are opaque.

In yet another aspect, the invention can be a method of forming an oral care implement comprising: injecting a first material in liquid form into a first mold cavity to form a body having a handle and a head, the first material being a hard plastic; mixing a plurality of first particles comprising a first color and a plurality of second particles comprising a second color with a second material in liquid form to form an elastomeric particle mixture, the second material comprising a transparent or translucent elastomer, the first and second colors being different; positioning the body into a second mold cavity; injecting the elastomeric particle mixture into the second mold cavity, the elastomeric particle mixture hardening to form an elastomeric component that is positioned on at least one of the handle and the head of the oral care implement.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
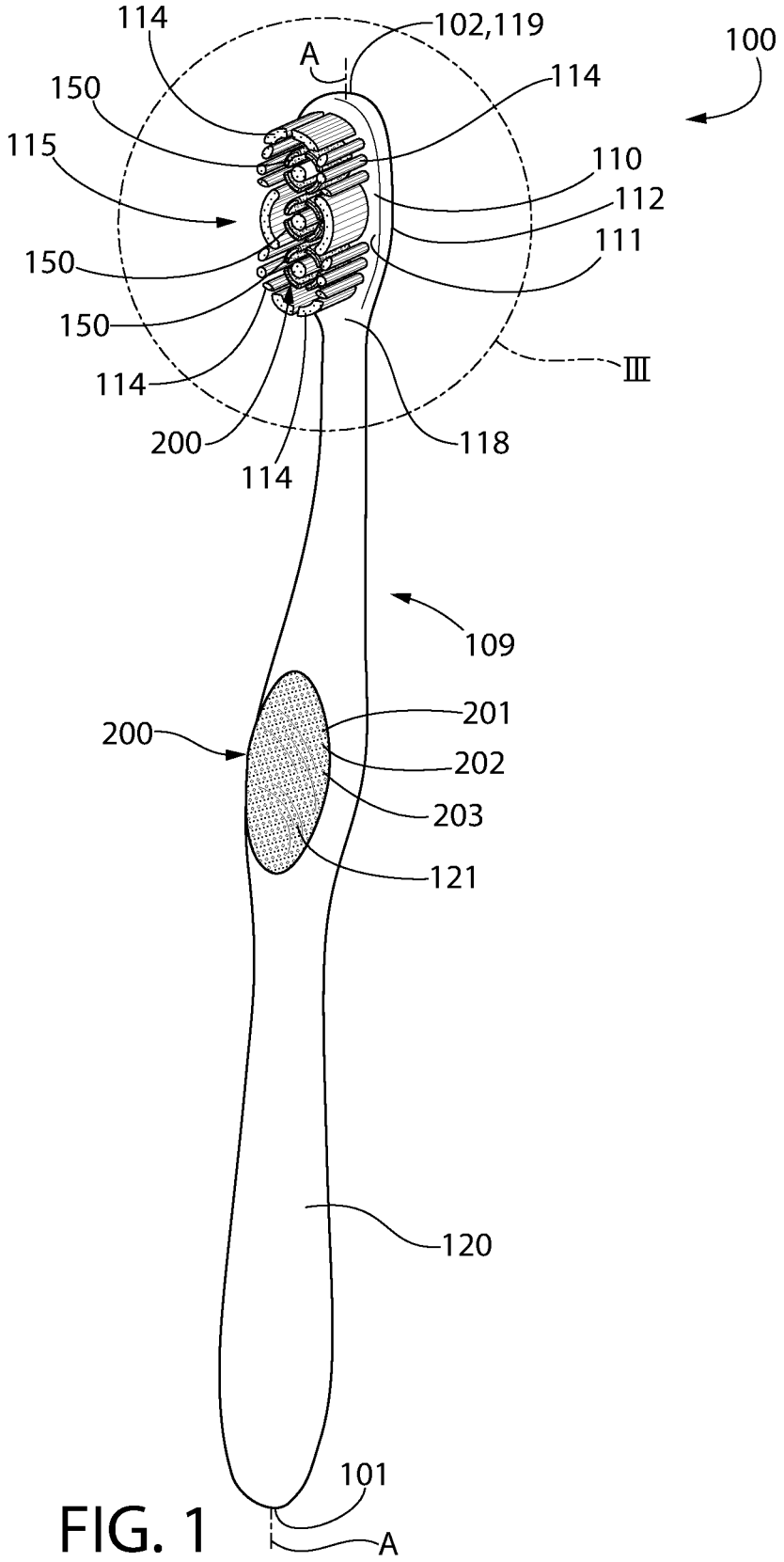
FIG. 1 is a front perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relatonships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
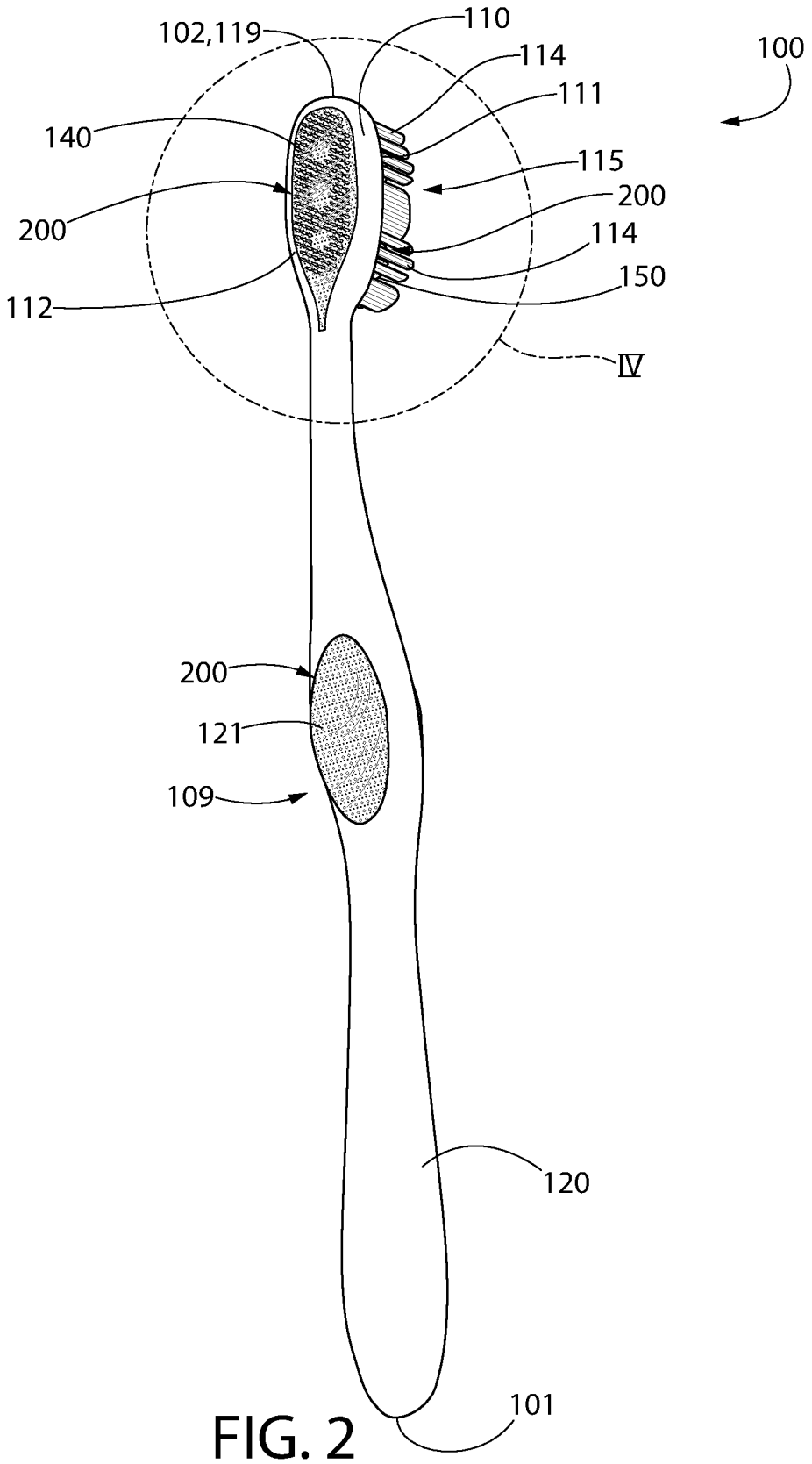
FIG. 2 is a rear perspective view of the oral care implement of FIG. 1.

Referring first to FIGS. 1 and 2 concurrently, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Thus, it is to be understood that the inventive concepts discussed herein can be applied to any type of oral care implement unless a specific type of oral care implement is specified in the claims.

The oral care implement 100 comprises a body 109 that extends from a proximal end 101 to a distal end 102 along a longitudinal axis A-A. The body 109 of the oral care implement 100 generally comprises a head 110 and a handle 120. The head 110 extends from a proximal end 118 to a distal end 119 along a longitudinal axis that is coextensive with the longitudinal axis A-A of the oral care implement 100. Furthermore, in the exemplified embodiment the distal end 102 of the oral care implement 100 is the same as the distal end 119 of the head 110.

The handle 120 is an elongated structure that provides the mechanism by which the user can hold and manipulate the oral care implement 100 during use. In the exemplified embodiment, the handle 120 is generically depicted having various contours for user comfort. Of course, the invention is not to be limited by the specific shape illustrated for the handle 120 in all embodiments and in certain other embodiments the handle 120 can take on a wide variety of shapes, contours, and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds, and polyesters such as polyethylene terephthalate. The handle 120 also includes a grip 121 that is formed of a resilient/elastomeric material and that is molded over a portion of the handle 120 that is typically gripped by a user's thumb and forefinger during use. The details of the grip 121 of the handle 120 will be discussed in more detail below. Furthermore, it should be appreciated that additional regions of the handle 120 can be overmolded with the resilient/elastomeric material to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used to form the handle 120, including metal, wood, or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 111 and an opposing rear surface 112. In the exemplified embodiment, the head 110 is formed integrally with the handle 120 as a single unitary structure using a molding, milling, machining, or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the head 110 may, in certain embodiments, be formed of any of the rigid plastic materials described above as being used for forming the handle 120, although the invention is not to be so limited in all embodiments and other materials that are commonly used during toothbrush head manufacture may also be used.

The oral care implement 100 also comprises a plurality of tooth cleaning elements 115 extending from the front surface 111 of the head 110. The details of certain ones of the plurality of tooth cleaning elements 115 will be discussed below. However, where it does not conflict with the disclosure below, the invention is not to be limited by the structure, pattern, orientation, and material of the tooth cleaning elements 115 in all embodiments. Furthermore, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, polybutylene terephthalate (PBT) bristles, spiral bristles, rubber bristles, elastomeric protrusions, flexible polymer protrusions, combinations thereof, and/or structures containing such materials or combinations. Thus, any combination of these tooth cleaning elements may be used within the tooth cleaning elements 115 in some embodiments. As described herein below, in one exemplary embodiment the tooth cleaning elements 115 may include one or more bristles formed from nylon or polybutylene terephthalate (PBT) that are either tapered or end-rounded, one or more spiral bristles, and one or more tooth cleaning elements formed of an elastomeric material.

In embodiments that use elastomeric materials to form one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth cleaning element may have a hardness property in the range of A10 to A70 Shore hardness in one embodiment, or A8 to A25 Shore hardness in another embodiment. One suitable elastomeric material is styrene-ethylene/butylene-styrene block copolymer (SEBS) manufactured by GLS Corporation. Nevertheless, SEBS material from other manufacturers or other materials within and outside the noted hardness range could be used. Suitable elastomeric materials also include a styrenic bulk copolymer (SBC) or a olefin block copolymer (OBC)

The tooth cleaning elements 115 may be coupled to the head 110 in any manner known in the art, including staples, in-mold tufting (IMT), anchor-free tufting (AFT), or a modified AFT known as AMR. However, referring briefly to FIG. 5, one manner in which the tooth cleaning elements 115 are secured to the head 110 via AFT will be described.

Figure 5:
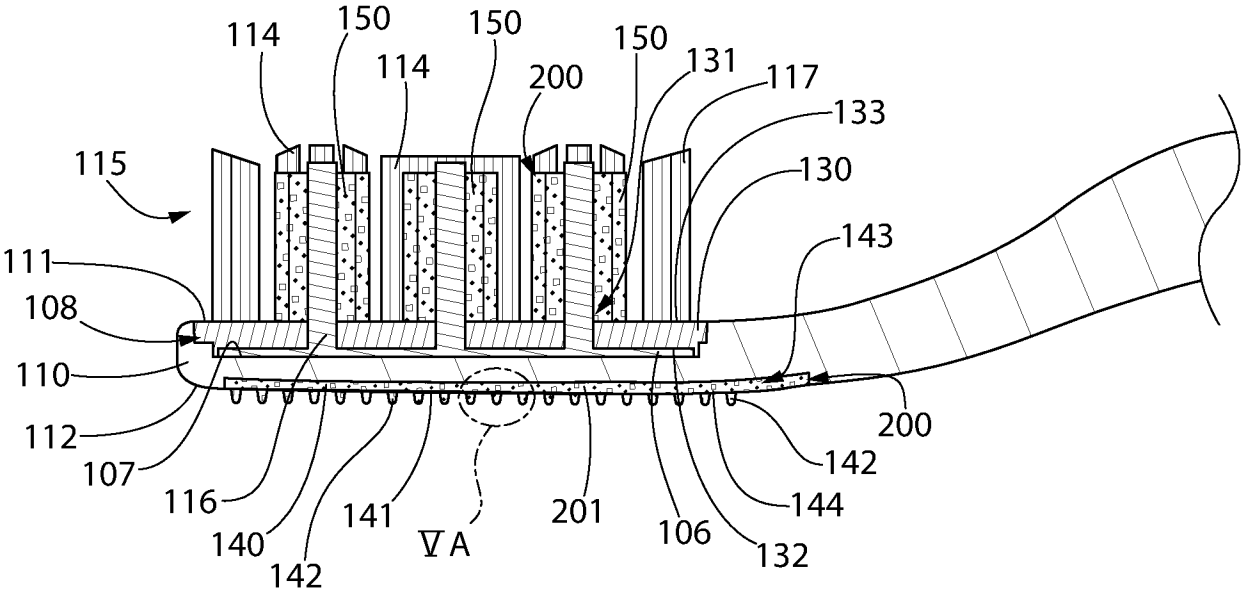
FIG. 5 is a cross-sectional view taken along line V-V of FIG. 3.

Specifically, in the embodiment exemplified in FIG. 5 the tooth cleaning elements 115 are formed as a cleaning element assembly on a head plate 130 such that one or more of the tooth cleaning elements 115 are mounted onto the head plate 130 and then the head plate 130 is coupled to the head 110. In such an embodiment, the head plate 130 is a separate and distinct component from the head 110 of the oral care implement 100. However, the head plate 130 is connected to the head 110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 130 and the head 110 are separately formed components that are secured together during manufacture of the oral care implement 100.

In certain embodiments, the head plate 130 may comprise an upper surface 133 and a lower surface 132. The upper surface 133 of the head plate 130 forms a portion of the front surface 111 of the head 110 when the head plate 130 is coupled to the head 110 as discussed herein. The head plate 130 comprises a plurality of holes 131 formed therethrough from the upper surface 133 to the lower surface 132, and the tooth cleaning elements 115 may be mounted to the head plate 130 within the holes 131. Specifically, in AFT a plate or membrane (i.e., the head plate 130) is created separately from the head 110. The tooth cleaning elements 115 (such as bristles, elastomeric elements, and combinations thereof) are positioned into the head plate 130 so as to extend through the holes 131 of the head plate 130. The free ends 117 of the tooth cleaning elements 115 on one side of the head plate 130 perform the cleaning function. The anchor portions 116 of the tooth cleaning elements 115 on the other side of the head plate 130 are melted together by heat to be anchored in place. As the tooth cleaning elements 115 are melted together, a melt matte 106 is formed. The melt matte 106 is a thin layer of plastic that is formed by melting the anchor portions 116 of the bristles so that the anchor portions 116 of the bristles transition into a liquid, at which point the liquid of the anchor portions 116 of the bristles combine together into a single layer of liquid plastic that at least partially covers the lower surface 132 of the head plate 130. After the heat is no longer applied, the melted anchor portions 116 of the bristles solidify/harden to form the melt matte 106 or thin layer of plastic.

After the tooth cleaning elements 115 are secured to the head plate 130, the head plate 130 is secured to the head 110 such as by ultrasonic welding so that the upper surface 133 of the head plate 130 forms at least a portion of the front surface 111 of the head 110. When the head plate 130 is coupled to the head 110, the melt matte 106 is located between the lower surface 132 of the head plate 130 and a floor 107 of a basin 108 of the head 110 in which the head plate 130 is disposed. The melt matte 106, which is coupled directly to and in fact forms a part of the tooth cleaning elements 115, prevents the tooth cleaning elements 115 from being pulled through the holes 131 in the head plate 130 to ensure that the tooth cleaning elements 105 remain attached to the head plate 130 during use of the oral care implement 100.

As noted above, in another embodiment the tooth cleaning elements may be connected to the head 110 using a technique known in the art as AMR. In this technique, the handle is formed integrally with the head plate as a one-piece structure. After the handle and the head plate are formed, the bristles are inserted into holes in the head plate so that the free/cleaning ends of the bristles extend from the front surface of the head plate and the bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte/thin layer of plastic. In some embodiments, after formation of the melt matte, a tissue cleanser is injection molded onto the rear surface of the head plate, thereby trapping the melt matte between the tissue cleanser and the rear surface of the head plate. In other embodiments, other structures may be coupled to the rear surface of the head plate to trap the melt matte between the rear surface of the head plate and such structure without the structure necessarily being a tissue cleanser (the structure can just be a plastic material that is used to form a smooth rear surface of the head, or the like).

Of course, techniques other than AFT and AMR can be used for mounting the tooth cleaning elements 115 to the head 110, such as widely known and used stapling techniques or the like. In such embodiments the head plate 130 may be omitted and the tooth cleaning elements 115 may be coupled directly to the head 110. Furthermore, in a further modified version of the AFT and AMR processes discussed above, the head plate 130 may be formed by positioning the tooth cleaning elements 115 within a mold, and then molding the head plate 130 around the tooth cleaning elements 115 via an injection molding process.

Referring again to FIGS. 1 and 2, the oral care implement 100 will be further described. In the exemplified embodiment, the plurality of tooth cleaning elements 115 includes a plurality of separate tufts of bristles 114 and a plurality of elastomeric tooth cleaning elements 150. Although illustrated herein as having a specific arrangement and shape, the arrangement of the tufts of bristles 114 and elastomeric tooth cleaning elements 150 as well as the shapes thereof can be modified from that which is depicted in the figures. Thus, the collective tooth cleaning elements 115 can be any pattern or arrangement and each one of the tooth cleaning elements 115 can have any desired shape. The details of the materials that make up the elastomeric tooth cleaning elements 150 will be described in more detail below with reference to FIG. 3.

The head 110 of the oral care implement 100 also includes a tissue cleanser 140 coupled to or positioned on its rear surface 112. An example of one suitable tissue cleanser that may be used with the present invention and positioned on the rear surface 112 of the head 110 is disclosed in U.S. Pat. No. 7,143,462, issued Dec. 5, 2006 to the assignee of the present application, the entirety of which is hereby incorporated by reference. The tissue cleanser 140 may include protuberances, which can take the form of elongated ridges, nubs, or combinations thereof. The details of one exemplary embodiment of the tissue cleanser 140, and particularly the materials that make up the tissue cleanser 140, will be discussed in more detail below with reference to FIG. 4-5A. Of course, in certain embodiments the oral care implement 100 may not include any soft tissue cleanser.

Still referring to FIGS. 1 and 2, the oral care implement 100 comprises an elastomeric component 200 positioned on at least one of the handle 120 and the head 110. More specifically, in the exemplified embodiment the elastomeric component 200 forms the tissue cleanser 140 on the rear surface 112 of the head 110, the grip 121 on the handle 120, and the elastomeric tooth cleaning elements 150 on the front surface 111 of the head 110. However, the invention is not to be so limited in all embodiments and in certain other embodiments the elastomeric component 200 may form any of one or more of the tissue cleanser 140, the grip 121, and the elastomeric tooth cleaning elements 150. Thus, the elastomeric component 200 may form any one, any two, or all three of the tissue cleanser 140, the grip 121, and one or more of the elastomeric tooth cleaning elements 150. Specifically, the materials that make up the elastomeric component 200 can be used to form several different features of the oral care implement 100, and specifically features that are formed of an elastomeric material.

Forming the tissue cleanser 140 out of the elastomeric component 200 ensures a comfortable cleaning of a user's soft tissue. Forming the grip 121 out of the elastomeric component 200 ensures a non-slip grip of the handle 120. Forming the elastomeric tooth cleaning elements 150 out of the elastomeric component 200 provides a wiping action to the teeth during tooth cleaning. Furthermore, as will be discussed below, the elastomeric component 200 creates a specific visual or aesthetic effect and its use on various portions of the oral care implement 100 will convey a cleaning, whitening, or other benefit of use to the user or consumer. Specifically, the elastomeric component 200 may create a visual signal of cleanliness, whitening capabilities, or the like as discussed below. The details of the elastomeric component 200 and the materials that it comprises will be discussed below with reference to FIGS. 3-6.

Figure 3:
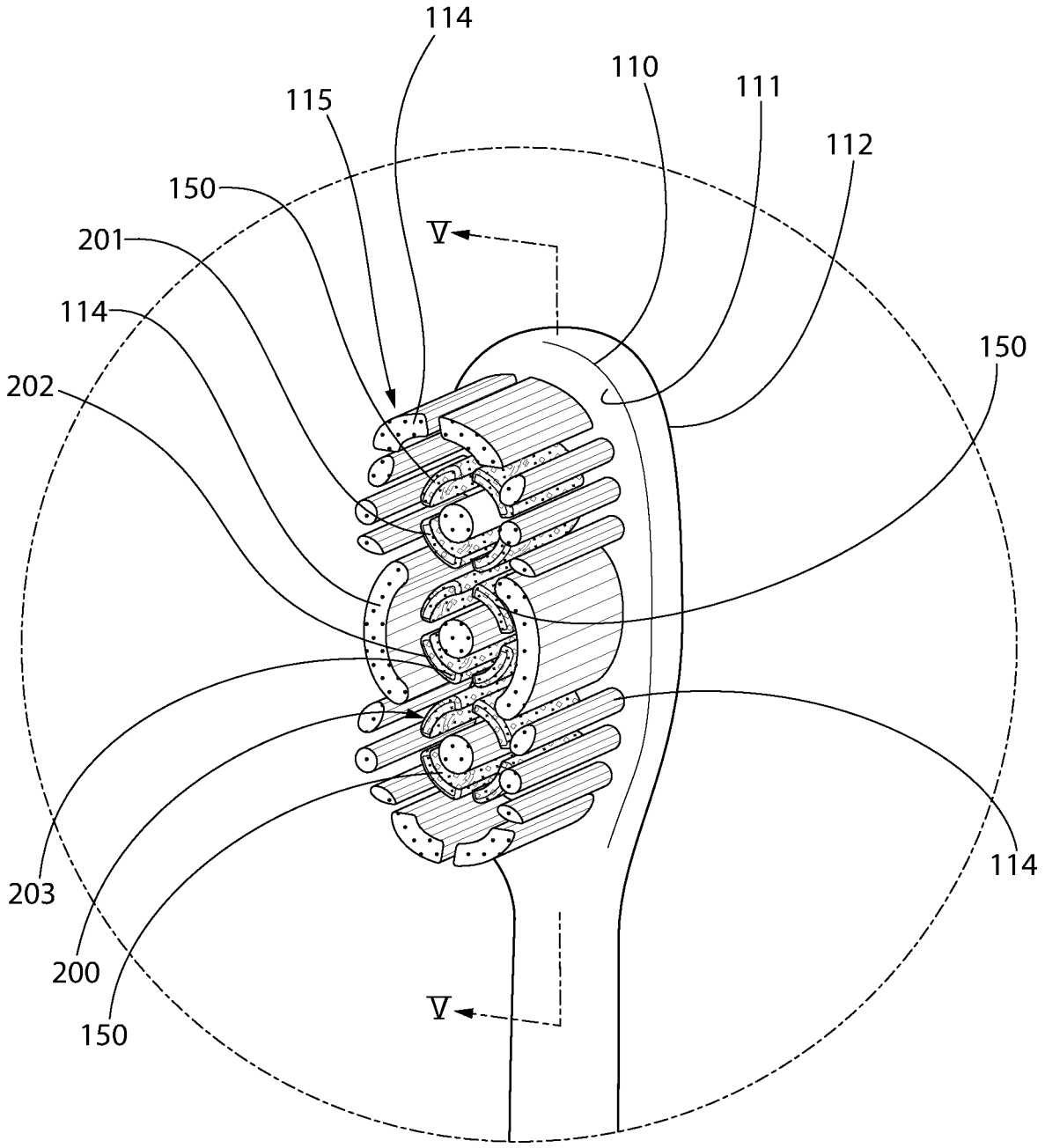
FIG. 3 is a close-up view of area III of FIG. 1.
Figure 4:
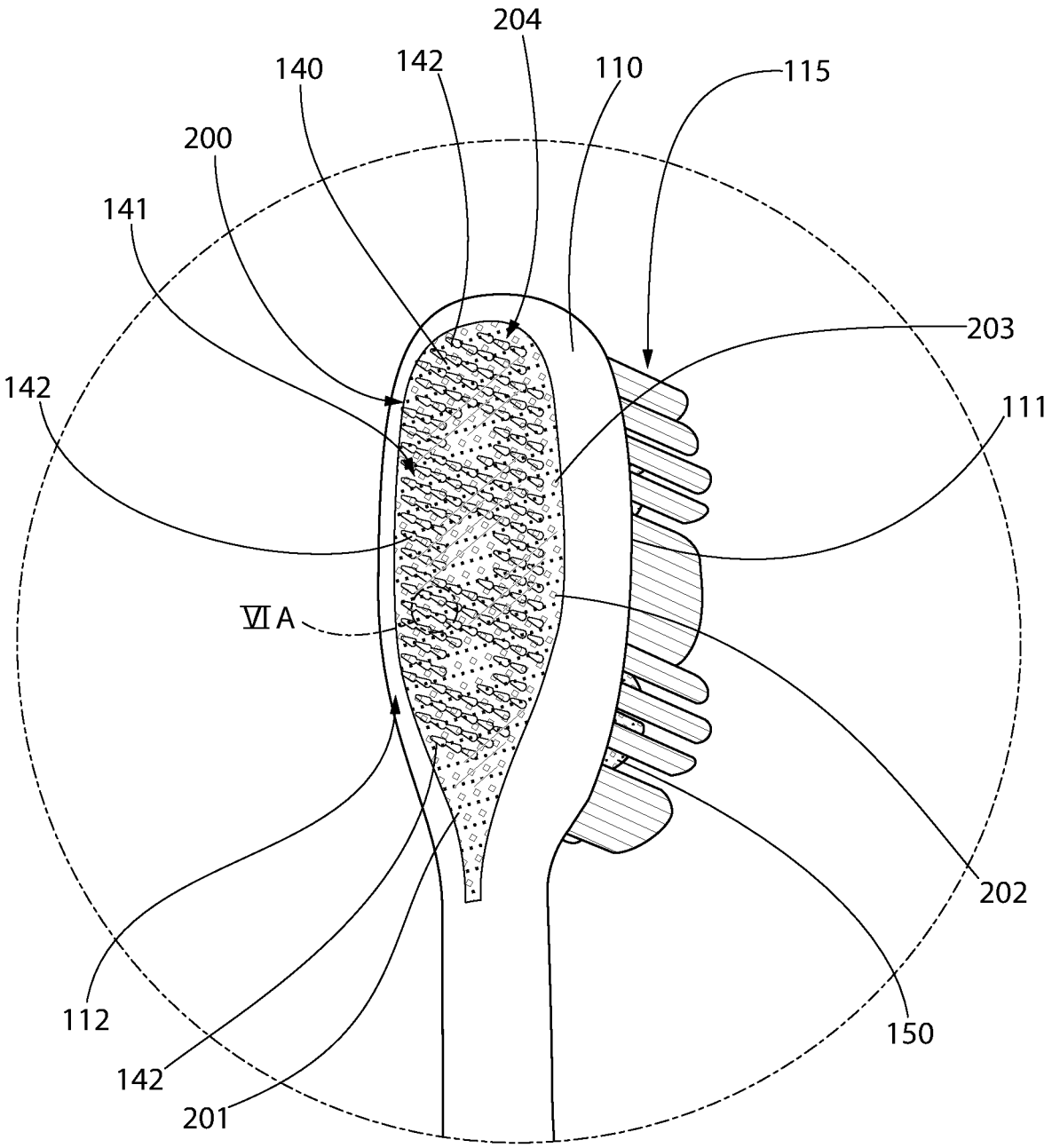
FIG. 4 is a close-up view of area IV of FIG. 2.
Figure 5A:
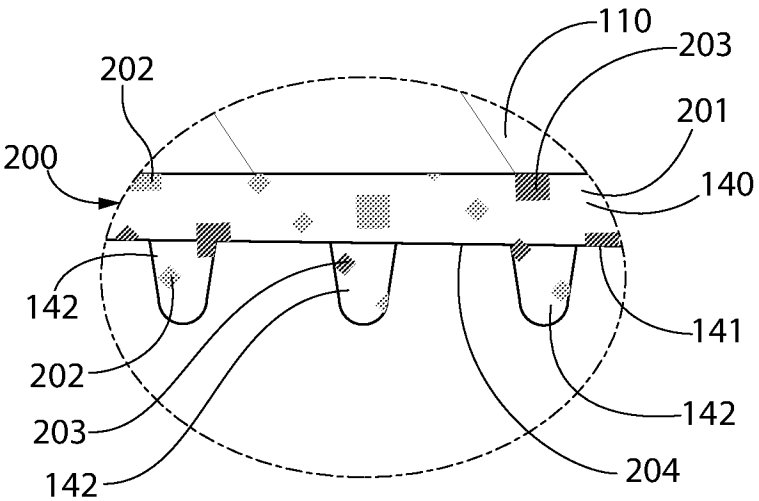
FIG. 5A is a close-up view of area VA of FIG. 5.

Referring to FIGS. 3-5A concurrently, the elastomeric component 200 will be described. FIG. 3 illustrates the elastomeric component 200 forming the elastomeric tooth cleaning elements 150 and FIGS. 4-5A illustrate the elastomeric component 200 forming the tissue cleanser 140. As noted above, the elastomeric component 200 can also be used to form the grip 121 on the handle 120, and thus the discussion of the elastomeric component 200 below is applicable to the grip 121 depicted in FIGS. 1 and 2 or any other type of grip that is overmolded onto the handle 120. Furthermore, although the close-up details of the elastomeric component 200 are only illustrated for the elastomeric component 200 that forms the tissue cleanser 140, it should be appreciated that the details of the elastomeric component 200 are equally applicable to the grip 121 and the elastomeric tooth cleaning elements 150 when the elastomeric component 200 forms the grip 121 and the elastomeric tooth cleaning elements 150.

In the exemplified embodiment, the elastomeric component 200 comprises a body 201, a plurality of first particles 202, and a plurality of second particles 203. Of course, the invention is not to be so limited in all embodiments and in certain other embodiments the elastomeric component 200 may only comprise the body 201 and the plurality of first particles 202. The body 201 of the elastomeric component 200 comprises (or is formed from) a transparent or translucent elastomeric material. Thus, the body 201 of the elastomeric component 200 may be transparent or completely clear in color (i.e., devoid of color) so that the body 201 can be readily seen through without any distortion of light. Alternatively, the body 201 of the elastomeric component 200 may be translucent such that the body 201 can still be seen through, but with some slight distortion due to the scattering of photons at the interface of the body 201. When the body 201 of the elastomeric component 200 is translucent, it may be tinted with any desired color while still permitting a user to see through the elastomeric component 200 as discussed herein. Regardless of whether the body 201 of the elastomeric component 200 is transparent or translucent, it is desirable that the plurality of first and second particles 202, 203 are readily visible through the body 201 as discussed in more detail below to create a desired aesthetic.

In addition to being transparent or translucent, as noted above the body 201 of the elastomeric component 200 is formed of an elastomeric material. This can include thermoplastic elastomers having a Shore A durometer value of between 10 and 70, between 20 and 60, between 30 and 50, or the like. The durometer value of the elastomeric material that forms the body 201 of the elastomeric component 200 is preferably selected to enhance the gripability of the handle 120 when the elastomeric component 200 forms the grip 121, and/or to enhance the cleaning/wiping action while ensuring comfort when the elastomeric component 200 forms the tissue cleanser 140 or the elastomeric tooth cleaning element 150. In certain embodiments, the body 201 of the elastomeric component 200 may be formed of an elastomeric material having one durometer value when used to form the grip 121 and a different durometer value when used to form the elastomeric tooth cleaning elements 150 or the tissue cleanser 140 in order to select a durometer value for the elastomeric material that is best suited for its intended use. Thus, although the elastomeric component 200 may form any of one or more of the grip 121, the elastomeric tooth cleaning elements 150, and the tissue cleanser 140, the elastomeric component 200 may have different characteristics in regard to transparency/translucency and hardness depending on the particular oral care implement 100 feature for which the elastomeric component 200 is used.

The body 201 of the elastomeric component 200 comprises an exposed surface 204. In the exemplified embodiment, the plurality of first particles 202 are embedded in the body 201 of the elastomeric component 200. Similarly, the plurality of second particles 203 are embedded in the body 201 of the elastomeric component 200. More specifically, in the exemplified embodiment each of the plurality of first and second particles 202, 203 are fully embedded within the body 201 such that none of the plurality of first and second particles 202, 203 protrudes beyond the exposed surface 204 of the body 201. However, the invention is not to be so limited in all embodiments and in certain other embodiments portions of some of the plurality of first and second particles 202, 203 may protrude beyond the exposed surface 204 of the body 201. In one embodiment, at least some of the plurality of first and second particles 202, 203 are fully embedded within the body 201 of the elastomeric component 200.

Furthermore, as can be seen in FIG. 5A, the plurality of first and second particles 202, 203 may be embedded within the body 201 of the elastomeric component 200 at different or varying depths. Thus, some of the plurality of first and/or second particles 202, 203 may be embedded at a first depth relative to the exposed surface 204, some of the plurality of first and/or second particles 202, 203 may be embedded at a second depth relative to the exposed surface 204, and some of the plurality of first and/or second particles 202, 203 may be embedded at a third depth relative to the exposed surface 204 such that the first, second, and third depths are different. Of course, three different depths are only described herein for exemplary purposes, and more or less than three different depths of embeddedness can be used. By embedding the particles 202, 203 at different depths, if the body 201 of the elastomeric component 200 is translucent, the particles 202, 203 that are embedded deeper will be less visible than the particles that are embedded less deep, thereby creating a visual effect. However, when the elastomeric material of the body 201 is transparent, the particles 202, 203 will be equally visible regardless of the depth at which they are embedded.

In the exemplified embodiment, the plurality of first and second particles 202, 203 are embedded within the body 201 of the elastomeric component 200 in a uniform, even distribution such that the plurality of first and second particles 202, 203 form a well-defined pattern within the body 201. Furthermore, in the exemplified embodiment the plurality of first and second particles 202, 203 have various square or rectangular shapes. However, the invention is not to be so limited and the plurality of first and second particles 202, 203 may be randomly arranged within the body 201 in other embodiments, one example of which will be discussed below with reference to FIG. 6. Furthermore, the plurality of first and second particles 202, 203 may have any polygonal shape, including irregular shapes, examples of which are depicted in and will be discussed below with reference to FIG. 6. Furthermore, the plurality of first and second particles 202, 203 may be flat, planar flake-like structures or they may be three-dimensional structures.

Figure 4A:
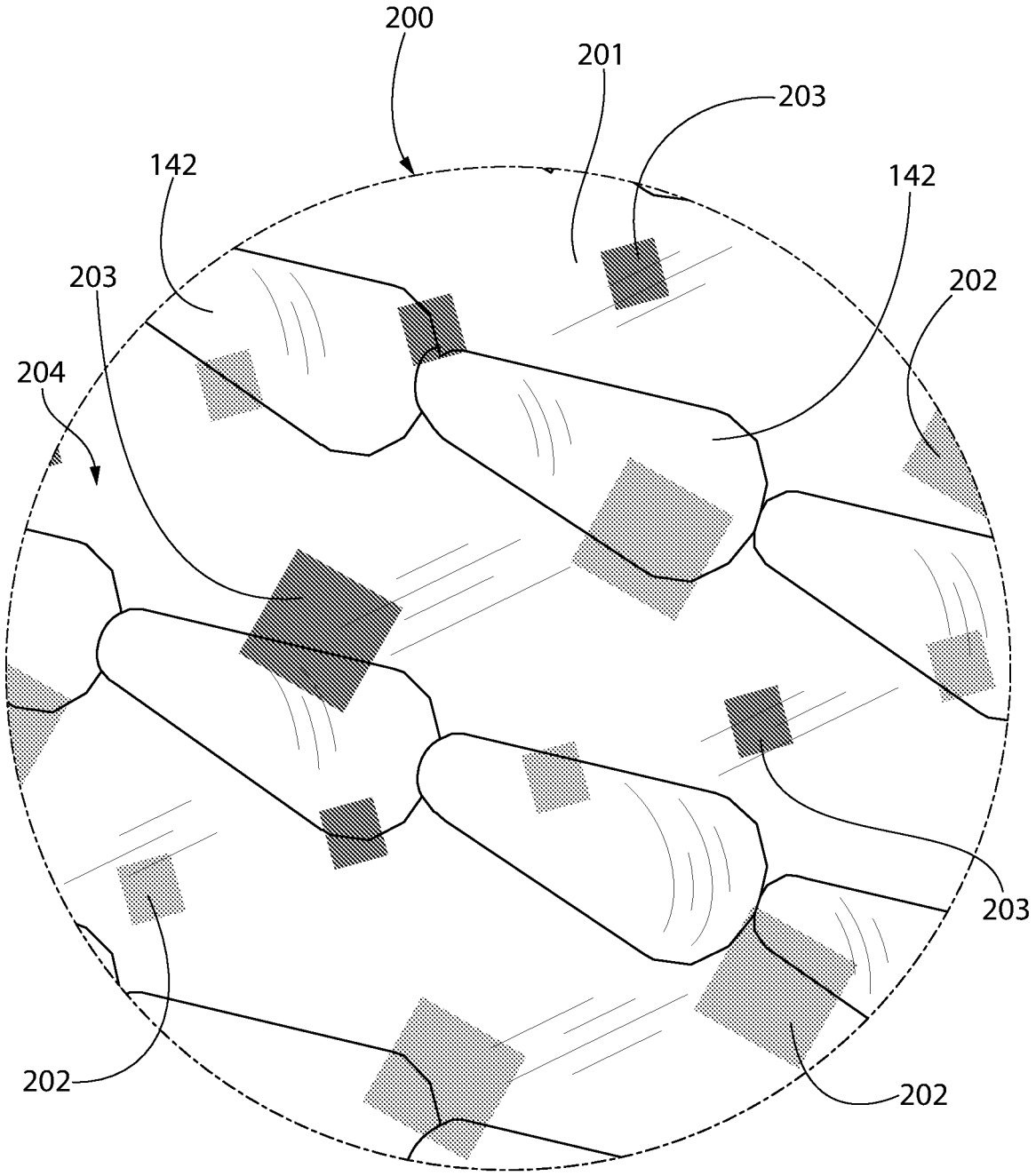
FIG. 4A is a close-up of area IVA of FIG. 4.

As best seen in FIGS. 4A and 5A, in the exemplified embodiment the plurality of first particles 202 comprise a first color and the plurality of second particles 203 comprise a second color such that the first and second colors are different. Thus, in one embodiment the plurality of first particles 202 may be white while the plurality of second particles 203 may be green, blue, purple, orange, red, black, or the like. Alternatively, the plurality of first particles 202 may be green, blue, purple, orange, red, black, or the like and the plurality of second particles 203 may be another one of green, blue, purple, orange, red, black, or the like. In one embodiment, the body 201 of the elastomeric component 200 is transparent, the plurality of first particles 202 are white, and the plurality of second particles 203 are blue or green. Furthermore, in certain embodiments the body 201 of the elastomeric component 200 may be transparent or translucent and the plurality of first and second particles 202, 203 may be opaque. In certain embodiments, the plurality of first and second particles 202, 203 may be rigid structures that are embedded within the resilient elastomeric material of the body 201 of the elastomeric component 200. Of course, the invention is not to be so limited in all embodiments and the plurality of first and second particles 202, 203 may also be resilient or flexible structures that are embedded within the resilient elastomeric material of the body 201 of the elastomeric component 200.

Due to the transparency or translucency of the elastomeric material that forms the body 201 of the elastomeric component 200, the plurality of first and second particles 202, 203 are visible through the exposed surface 204 of the body 201 of the elastomeric component 200. Thus, a viewer or consumer can view the oral care implement 100 and can see the elastomeric component 200 forming at least one of the grip 121, the tissue cleanser 140, and the elastomeric tooth cleaning element 150. Upon viewing the elastomeric component 200, the viewer or consumer will readily visualize the plurality of first and second particles 202, 203 as they appear to be floating with the body 201 of the elastomeric component 200. This will create a certain visual effect to the consumer. Specifically, depending on the particular colors used for the first and second particles 202, 203, a specific effect can be conveyed to the consumer, as discussed below.

In one embodiment, the first and second colors of the plurality of first and second particles 202, 203 may be selected to represent a characteristic of the oral care implement 100. The characteristic of the oral care implement 100 may be a type of bristle of the oral care implement 100, a specific type of cleaning that the oral care implement 100 is best suited for, or an oral care benefit achieved by the oral care implement 100. For example, the characteristic may be that the bristles include tapered bristles, spiral bristles, or charcoal bristles, or the characteristic may be that the oral care implement 100 is best suited for tooth whitening, interdental cleaning, or odor absorption. The oral care implement 100 may be sold in a package that includes a color code key so that the user or consumer will readily understand what the specific colors of the plurality of first and second particles 202, 203 represent. Alternatively, the color code key may be placed directly onto the oral care implement 100, such as on the handle 120 of the oral care implement 100 or the like. In one embodiment, the colors white and blue may indicate that the bristles are spiral and best used for tooth whitening. In another embodiment, the colors white and black may indicate that the bristles are charcoal bristles and best used for odor absorption. In yet another embodiment, the colors white and red may be used to indicate that the bristles are tapered and best used for interdental cleaning. Of course, the colors denoted herein are merely exemplary in nature and are not intended to be limiting unless specifically recited in the claims.

In one embodiment, a sensory material may be incorporated into the elastomeric component 200. A sensory material may be a material that results in a trigeminal response to the user, a flavor, or a scent. The sensory material may be incorporated into the elastomeric material that forms the body 201 of the elastomeric component 200 before the elastomeric material is injected onto the desired region of the oral care implement 100 to form the grip 121, tissue cleanser 140, or the elastomeric tooth cleaning element 150. Specifically, the sensory material may be mixed into the melted form of the elastomeric material that is later injected onto the oral care implement 100. In such an embodiment, the first and second colors of the first and second particles 202, 203 may be indicative of the sensory effect achieved by the sensory material. Specifically, the sensory material may create a cooling effect to a user during use. In such an embodiment, the first and second colors may be white and blue to convey this cooling effect. The colors white and blue may also be used to indicate a peppermint flavoring. In another embodiment, the sensory material may create a feeling of heat, and in such an embodiment the first and second colors may be white and red to convey this heat effect. In still another embodiment, the first and second colors may be white and green to convey a spearmint flavoring or the sensory effect of a tingle. Again, the specific colors denoted herein are merely exemplary in nature and are not intended to be limiting unless specifically recited in the claims.

Furthermore, in still other embodiments an active agent can be incorporated into the elastomeric component 200. The active agent can be a natural ingredient such as, for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+. Alternatively, the active agent can be a tooth whitening agent, a tooth sensitivity agent, a fluoride agent, an antimicrobial agent, an antibacterial agent, or the like. The colors of the plurality of first and second particles 202, 203 can be selected to be indicative of the active agent that is incorporate into the elastomeric component 200 if so desired. Furthermore, a color code key as described above can be used to more readily convey to a user/consumer the specific active agent that corresponds to the colors of the plurality of first and second particles 202, 203.

As noted above, the plurality of first and second particles 202, 203 may be added to a melted form of the elastomeric material that forms the body 201 of the elastomeric component 200 before the elastomeric component 200 is injection molded onto the oral care implement 100 to form one or more of the grip 121, the tissue cleanser 140, and the elastomeric tooth cleaning elements 150. In that regard, the plurality of first particles 202 may have a first melting temperature, the plurality of second particles 203 may have a second melting temperature, and the elastomeric material that forms the body 201 may have a third melting temperature. Furthermore, in an exemplary embodiment, each of the first and second melting temperatures is greater than the third melting temperature. In one embodiment, the first and second melting temperatures may be the same. In another embodiment, the first and second melting temperatures may be different, but still both of the first and second melting temperatures will be greater than the third melting temperature. This will ensure that the plurality of first and second particles 202, 203 remain in solid form during the injection molding step so that the plurality of first and second particles 202, 203 do not simply melt into the elastomeric material of the body 201, but rather remain distinct, embedded within, and visible through the elastomeric material of the body 201.

Referring now to FIGS. 4-5A concurrently, the details of the tissue cleanser 140, which is formed from the elastomeric component 200, will be described. As noted above, in the exemplified embodiment the elastomeric component 200, which comprises the body 201 and the plurality of first and second particles 202, 203, forms the tissue cleanser 140. The tissue cleanser 140 is positioned on the rear surface 112 of the head 110 and is used for cleaning a user's soft tissue surfaces and/or tongue as desired. The tissue cleanser 140 may be injection molded into a recess 143 formed into the rear surface 112 of the head 110 (see FIG. 5), injection molded directly onto the rear surface 112 of the head 110, or otherwise secured to the head 110 via adhesion, fasteners, or the like. The tissue cleanser 140 comprises a pad 144 having an exposed surface (or outer surface) 141 that may be flush with the rear surface 112 of the head 110, and may in fact form a portion of the rear surface 112 of the head 110. Furthermore, the tissue cleanser 140 comprises a plurality of protuberances 142 extending from the exposed surface 141 of the pad 144, only some of which are labeled in the drawings to avoid clutter.

In the exemplified embodiment, each of the plurality of protuberances 142 is in the form of a nub. As used herein a "nub" generally refers to a column-like protrusion (without limitation to the cross-sectional shape of the protrusion) which is upstanding from a base surface. In a general sense, the protuberances 142 in the preferred construction have a height that is greater than the width at the base of the protuberance 142 (as measured in the longest direction). Nevertheless, protuberances or nubs could include projections wherein the widths and heights are roughly the same or wherein the heights are somewhat smaller than the base widths. Moreover, in some circumstances (e.g., where the protuberances taper to a tip or include a base portion that narrows to a smaller projection), the base width can be substantially larger than the height.

In one preferred arrangement of the tissue cleanser 140, the plurality of protuberances 142 are preferably conically shaped. As used herein, "conically shaped" or "conical" is meant to include true cones, frusto-conically shaped elements, and other shapes that taper to a narrow end and thereby resemble a cone irrespective of whether they are uniform, continuous in their taper, or have rounded cross-sections. In certain other embodiments, the protuberances 142 of the tissue cleanser 140 can take the form of elongated ridges, nubs, or combinations thereof. In the exemplified embodiment, the tissue cleanser 140, including the pad 144 and the protuberances 142, is formed from the elastomeric component 200, which may be a resilient material such as an injection molded thermoplastic elastomer. Furthermore, the invention is not limited to an embodiment that incorporates a tissue cleanser 140 on the rear surface 112 of the head 110 and in certain other embodiments the tissue cleanser 140 may be omitted.

Referring to FIGS. 1 and 2, the details of the grip 121, which is formed from the elastomeric component 200, will be described. As noted above, in the exemplified embodiment the elastomeric component 200, which comprises the body 201 and the plurality of first and second particles 202, 203, forms the grip 121. Thus, the grip 121 is formed from the elastomeric material of the elastomeric component 200 and may include any of the features of the elastomeric component 200 discussed above. In the exemplified embodiment, the grip 121 is formed into an oval-shaped region of the handle 120 where the thumb and forefinger would grip the handle 120 during use. The grip 121 may be inserted within an aperture in the handle 120 so that the grip 121 is exposed on both the front and rear surfaces of the handle 120 to facilitate gripping of the handle 120. Alternatively, the grip 121 may be positioned within separate openings on each of the front and rear surfaces of the handle 120, or only one of the front and rear surfaces of the handle 120 may include the grip 121. Although not illustrated in the exemplified embodiment, the grip 121 may include protrusions, ribs, ridges, or the like thereon to enhance the gripability thereof.

Although the grip 121 is depicted only as an oval-shaped structure in the exemplified embodiment, the invention is not to be so limited. In some embodiments, a majority or entirety of the handle 120 may be overmolded with the elastomeric component 200 thereby forming a gripping surface on the handle 120. Thus, the exact shape, dimensions, and the like of the grip 121 are not to be limiting of the present invention unless specifically claimed. Rather, in certain embodiments a portion of the handle 120 is overmolded with the elastomeric component 200 to form a grip that enhances the ability of a user to grip the handle 120 during use.

Referring to FIG. 3, the details of the elastomeric tooth cleaning element 150, which is formed from the elastomeric component 200, will be described. As noted above, in the exemplified embodiment the elastomeric component 200, which comprises the body 201 and the plurality of first and second particles 202, 203, forms the elastomeric tooth cleaning element 150. In the exemplified embodiment, the oral care implement 100 includes three separate regions having four elastomeric tooth cleaning elements 150 that are oriented in a loop. In this embodiment, each of the elastomeric tooth cleaning elements 150 is arcuate in shape. Of course, the invention is not to be so limited and the elastomeric tooth cleaning elements 150 can take on any desired shape and be located at any desired position on the head. It is merely desirable in some embodiments that one or more elastomeric tooth cleaning elements 150 extend or protrude from the front surface 111 of the head 110 and be formed of the elastomeric component 200 such that the plurality of first and second particles 202, 203 are visible within the one or more elastomeric tooth cleaning elements 150.

As discussed above, when the elastomeric component 200 forms the tissue cleanser 140, the elastomeric component 200 is molded onto the rear surface 112 of the head 110. When the elastomeric component 200 forms an elastomeric tooth cleaning element 150, the elastomeric component 200 is molded onto the front surface 111 of the head 110. When the elastomeric component 200 forms the grip 121, the elastomeric component 200 is molded onto the front and/or rear surfaces of the handle 120. In one embodiment, elastomeric component 200 may be considered to be molded onto a region of at least one of the handle 120 or the head 110. In such embodiment, the region of the handle 120 or the head 110 that the elastomeric component 200 is molded onto has a third color that is different than the color of at least one of the plurality of first particles 202 and the plurality of second particles 203. Thus, the portion of the handle 120 or head 110 to which the elastomeric component 200 is overmolded may be an opaque color that contrasts with either the first color of the plurality of first particles 202 or the second color of the plurality of second particles 203. Thus, for example, if the first color of the plurality of first particles 202 is white, the third color of the region of the handle 120 and/or head 110 that the elastomeric component 200 is molded onto may be any color that is different than and contrasts with white, such as blue, green, red, or the like. As another example, if the first color of the plurality of first particles 202 is blue, the third color of the region of the handle 120 and/or head 110 that the elastomeric component 200 is molded onto may be any color that is different than and contrasts with blue, such as white, red, green, or the like. Furthermore, if the first color of the plurality of first particles 202 is white and the second color of the plurality of second particles 203 is blue, the region of the handle 120 and/or head 110 to which the elastomeric component 200 is molded may be white (so as to be different than the second color but the same as the first color), blue (so as to be different than the first color but the same as the second color), or some other color that is different than both of the first and second colors.

Figure 6:
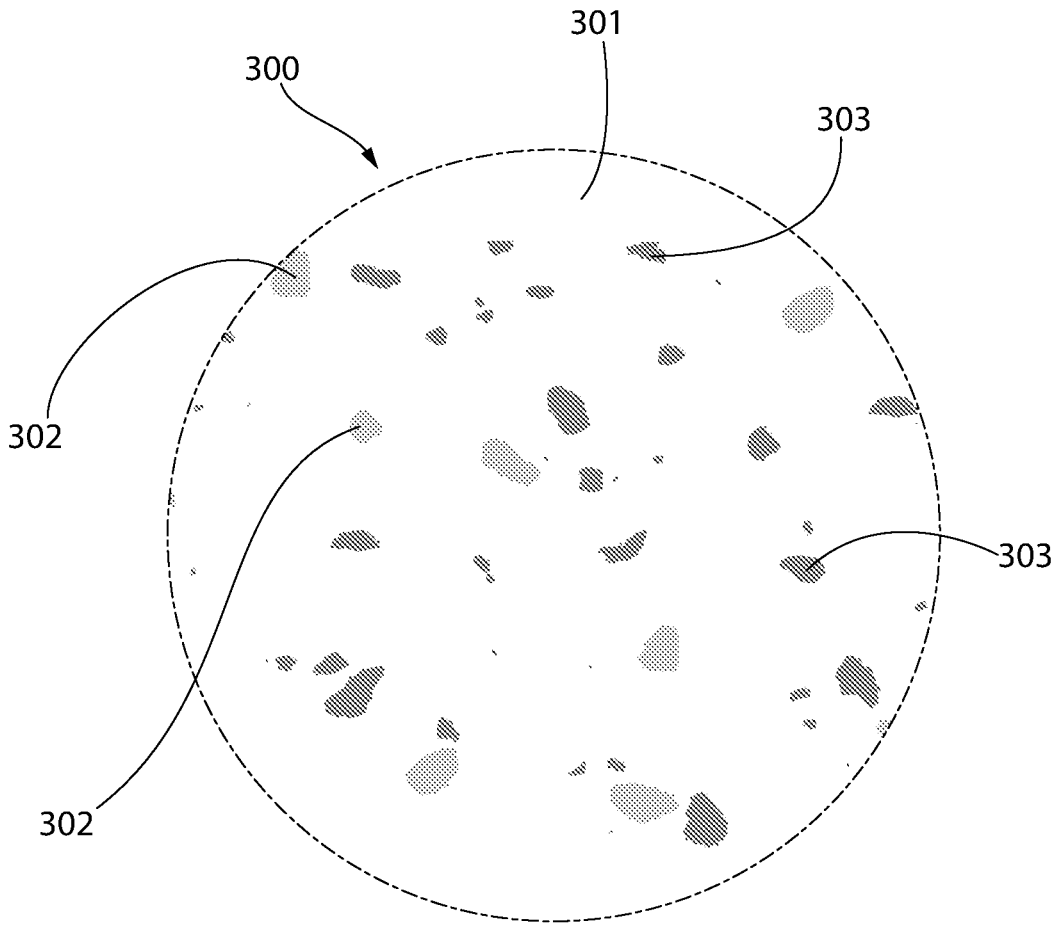
FIG. 6 is a close-up view of an elastomeric component of the oral care implement of FIG. 1 in accordance with another embodiment of the present invention.

Referring to FIG. 6, a close-up view of an alternative embodiment of an elastomeric component 300 is illustrated. The elastomeric component 300 is similar to the elastomeric component 200 except as discussed below, and thus the discussion of the elastomeric component 200 is equally applicable to the elastomeric component 300 where it does not conflict with the description of the elastomeric component 300 below.

The elastomeric component 300 comprises a body 301, a plurality of first particles 302, and a plurality of second particles 303. The body 301 may be formed from a transparent or translucent elastomeric material, such as a thermoplastic elastomer. The plurality of first particles 302 comprise a first color and the plurality of second particles 303 comprise a second color that is different than the first color. The main difference between the elastomeric component 300 relative to the elastomeric component 200 is in the shape and size of the plurality of first and second particles 302, 303. Specifically, with the elastomeric component 200, the plurality of first and second particles 202, 203 are evenly distributed and have shapes with four corners and sides. With the elastomeric component 300, the plurality of first and second particles 302, 303 are randomly distributed/dispersed within the body 301 and have varying shapes and sizes. Specifically, in the exemplified embodiment the plurality of first and second particles 302, 303 are irregular shapes.

Furthermore, in the exemplified embodiment the plurality of first and second particles 302, 303 have an upper surface having a minimum dimension that is greater than or equal to 50 μm, or greater than or equal to 100 μm, or greater than or equal to 200 μm, or greater than or equal to 300 μm, or greater than or equal to 400 μm, or greater than or equal to 500 μm. Furthermore, the upper surfaces of the plurality of first and second particles 302, 303 have a maximum dimension less than or equal to 1,000 μm, less than or equal to 900 μm, less than or equal to 800 μm, less than or equal to 700 μm, or less than or equal to 600 μm. In certain embodiments, the upper surfaces of the plurality of first and second particles 302, 303 may have a planar area (or cross-sectional area) between 500 $\mu m^2$ and 1,000,000 $\mu m^2$, more specifically between 1,000 $\mu m^2$ and 100,000 $\mu m^2$, and still more specifically between 5000 $um^2$ and 50,000 $\mu m^2$. Furthermore, some of the plurality of first and second particles 302, 303 may be small and speck-like and have a planar area of around 500 $\mu m^2$ whereas others of the plurality of first and second particles 302, 303 have a larger size with a planar area of around 1,000,000 $\mu m^2$. Furthermore, in certain embodiments the elastomeric component 300 may comprise between 500 and 2,000, or more specifically between 750 and 1,500, of the plurality of first and second particles per square inch of the body 301.

In one embodiment, the first and second particles 302, 303 may provide a sparkling appearance in the color(s) of the particle 302, 303 when illuminated by visible light. In one embodiment, suitable first and second particles 302, 303 are commercially available as the Megaspecks® product line in a number of colors from Apex Colors of Bensonville, Ill., USA. Apex Colors identify its Megaspecks® products as proprietary products used to prepare granite-effects in plastics and solid surfaces. The particles 302, 303 are resistant to the shear and heat seen during extrusion, blow molding, and injection molding processes. Preferably, the additive is FDA-compliant with excellent light resistance and chemical stability. The Megaspecks® product line possesses such properties. While the product line is proprietary to Apex Colors, it is known that the Megaspecks® product line does not use metallic particles. It is believed that the Megaspecks® product line uses colored thermoset polymer cut into micrometric mean particle sizes.

Referring to the figures collectively, a method of forming the oral care implement 100 will be described. First, a first material in liquid form is injected into a first mold cavity to form the body 109 of the oral care implement 100. Specifically, the first mold cavity has a size and shape necessary to form the handle 120 and the head 110 of the oral care implement 100 as a unitary structure. Next, the first material is allowed to cool and harden to form the body 109 of the oral care implement 100. After the body 109 of the oral care implement 100 has formed and hardened, the body 109 of the oral care implement 100 is removed from the first mold cavity and inserted into a second mold cavity.

Next, the plurality of first particles 202 comprising the first color and the plurality of second particles 203 comprising the second color are mixed with a second material that has been melted into a liquid. In certain embodiments, the second material is a transparent or translucent elastomer, and the second material is heated to the point of melting before being mixed with the plurality of first and second particles 202, 203. Due to the plurality of first and second particles 202, 203 having a higher melting temperature than the transparent or translucent elastomer, the plurality of first and second particles 202, 203 do not melt during this mixing step. Mixing the plurality of first and second particles 202, 203 with the transparent or translucent elastomer forms an elastomeric particle mixture.

Next, with the body 109 of the oral care implement 100 positioned within the second mold cavity, the elastomeric particle mixture is injected into the second mold cavity. The second mold cavity may be sized and shaped so that injection of the elastomeric particle mixture into the second mold cavity forms one or more of the grip 121 on the handle 120, the tissue cleanser 140 on the rear surface 112 of the head 110, and the elastomeric tooth cleaning elements 150 on the front surface 111 of the head 110. After the elastomeric particle mixture is injected into the second mold cavity, the elastomeric particle mixture is allowed to cool and harden to form the elastomeric component 200. Depending on the location at which the elastomeric particle mixture is injected, the elastomeric component 200 may form one or more of the grip 121, the tissue cleanser 140 and the elastomeric tooth cleaning elements 150. Either before or after the injection of the elastomeric particle mixture, the tooth cleaning elements 115 may be coupled to the head plate 130, and the head plate 130 coupled to the head 110 of the oral care implement 100 (or the tooth cleaning elements 1150 can be coupled to the head 110 using any of the other techniques disclosed herein). Furthermore, in some embodiments the elastomeric tooth cleaning element 150 may be formed in a separate injection molding step than the formation of the grip 121 and/or the tissue cleanser 140 (such as injection molding the elastomeric particle mixture directly onto the head plate 130 prior to securing the head plate 130 to the head 110).

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:
a handle formed of a hard plastic material;
a head coupled to the handle, the head having a front surface and an opposing rear surface, the head formed of the hard plastic material;
an elastomeric component positioned on at least one of the handle and the head, the elastomeric component comprising a body, a plurality of first particles embedded in the body, and a plurality of second particles embedded in the body;
wherein the body comprises a transparent or translucent elastomeric material; and
wherein the plurality of first particles comprise a first color and the plurality of second particles comprise a second color, the first color being different than the second color.

2. The oral care implement according to claim 1 wherein the elastomeric component forms a tissue cleanser positioned on the rear surface of the head, the tissue cleanser comprising an exposed surface with a plurality of protuberances extending therefrom.

3. The oral care implement according to claim 1 further comprising a plurality of tooth cleaning elements extending from the front surface of the head, the plurality of tooth cleaning elements including at least one bristle and at least one elastomeric tooth cleaning element, and wherein the elastomeric component forms the at least one elastomeric tooth cleaning element.

4. The oral care implement according to claim 3 wherein the head comprises a head plate, the head plate comprising a lower surface, an upper surface that forms at least a portion of the front surface of the head, and a plurality of through holes extending from the lower surface of the head plate to the upper surface of the head plate, wherein the plurality of tooth cleaning elements include a plurality of bristles, each of the plurality of bristles comprising a cleaning portion protruding from the upper surface of the head plate and an anchor portion located adjacent the lower surface of the head plate, the anchor portions of the plurality of bristles melted together to form a melt matte adjacent the lower surface of the head plate, and wherein the at least one elastomeric tooth cleaning element is positioned within one of the through holes of the head plate and protrudes from the front surface of the head.

5. The oral care implement according to claim 1 wherein the elastomeric component forms a grip on the handle.

6. The oral care implement according to claim 1 wherein the plurality of first particles has a first melting temperature, the plurality of second particles has a second melting temperature, and the elastomeric body has a third melting temperature, and wherein the first melting temperature is greater than the third melting temperature and the second melting temperature is greater than the third melting temperature.

7. The oral care implement according to claim 1 wherein the plurality of first and second particles are visible through an exposed surface of the body of the elastomeric component.

8. The oral care implement according to claim 1 wherein the plurality of first and second particles comprise an irregular shape with an upper surface having a minimum dimension greater than or equal to 50 μm, a maximum dimension less than or equal to 1,000 μm, and a planar area between 500 $\mu m^2$ and 1,000,000 $\mu m^2$, and wherein the elastomeric component comprises between 500 and 2,000 of the plurality of first and second particles per square inch of the body.

9. The oral care implement according to claim 1 further comprising a sensory material incorporated into the elastomeric component, wherein the first and second colors of the first and second particles are indicative of a sensory effect of the sensory material.

10. The oral care implement according to claim 1 wherein the first and second colors of the plurality of first and second particles are selected to represent a characteristic of the oral care implement.

11. The oral care implement according to claim 10 wherein the characteristic is a type of bristles or an oral care benefit achieved by the oral care implement.

12. The oral care implement according to claim 1 wherein one of the first and second colors is white, and wherein the body is transparent.

13. The oral care implement according to claim 12 wherein the body is formed of a thermoplastic elastomer having a Shore A hardness between 10 and 70 and wherein the plurality of first and second particles are opaque.

14. The oral care implement according to claim 1 wherein all of the plurality of first and second particles are fully embedded within the body such that none of the plurality of first and second particles protrudes beyond an exposed surface of the body.

15. A method of forming an oral care implement comprising:

injecting a first material in liquid form into a first mold cavity to form a body having a handle and a head, the first material comprising a hard plastic;

mixing a plurality of first particles comprising a first color and a plurality of second particles comprising a second color with a second material in liquid form to form an elastomeric particle mixture, the second material comprising a transparent or translucent elastomer, the first and second colors being different;

positioning the body into a second mold cavity;

injecting the elastomeric particle mixture into the second mold cavity, the elastomeric particle mixture hardening to form an elastomeric component that is positioned on at least one of the handle and the head of the oral care implement.

* * * * *